United States Patent [19]

Carlisle, Jr.

[11] Patent Number: 4,939,904

[45] Date of Patent: Jul. 10, 1990

[54] UNIVERSAL ACCUMULATOR

[76] Inventor: Billy M. Carlisle, Jr., 6415 Jetty, San Antonio, Tex. 78239

[21] Appl. No.: 355,424

[22] Filed: May 22, 1989

Related U.S. Application Data

[62] Division of Ser. No. 139,858, Dec. 30, 1987, Pat. No. 4,835,986.

[51] Int. Cl.[5] ..... F25B 43/00

[52] U.S. Cl. ..... 62/77; 62/503; 137/615

[58] Field of Search ..... 62/503, 77; 285/282, 285/184, 30; 403/78, 84; 137/615

[56] References Cited

U.S. PATENT DOCUMENTS

| | | | |
|---|---|---|---|
| 1,138,107 | 5/1915 | Hill | 137/590 |
| 1,372,466 | 3/1921 | Whoolery | 137/577 |
| 1,395,753 | 11/1921 | Wehle | 137/590 |
| 2,926,935 | 3/1960 | La Marre | 285/184 |
| 2,953,906 | 9/1960 | Quick | 62/503 X |
| 3,049,171 | 8/1962 | Neuerburg et al. | 137/590 |
| 3,483,889 | 12/1969 | Bowles | 137/575 |
| 3,931,922 | 1/1976 | Coel | 285/30 |
| 4,280,721 | 7/1981 | Narkon | 285/184 X |
| 4,291,548 | 9/1981 | Livesay | 62/503 |

FOREIGN PATENT DOCUMENTS

| | | | |
|---|---|---|---|
| 120090 | 11/1947 | Sweden | 285/184 |
| 379521 | 9/1932 | United Kingdom | 285/282 |
| 677237 | 8/1952 | United Kingdom | 285/184 |
| 2172694 | 9/1986 | United Kingdom . | |

OTHER PUBLICATIONS

Copy of pp. 333–355 of a catalog published by Jet Air, Inc., of Grand Prairie, Texas, dated Jun. 1, 1987, entitled "Air Conditioning Heating Parts, Tools & Supplies".

*Primary Examiner*—William E. Tapolcai
*Attorney, Agent, or Firm*—Richard J. Smith

[57] ABSTRACT

A universal accumulator for utilization in an automotive air conditioning system. An inlet fitting and an outlet fitting are connected to the top of the accumulator housing. The adjustable connection of the outlet fitting to approximately the center of the housing top permits the variable positioning of the outlet port relative to the inlet port and utilization of the accumulator in a wide variety of automobile applications. A method for replacing an accumulator with the universal accumulator of the present invention is also disclosed.

3 Claims, 5 Drawing Sheets

UNIVERSAL ACCUMULATOR

This is a continuation of co-pending application no. 07/139,858 filed on Dec. 30, 1987, now U.S. Pat. No. 4,835,986.

BACKGROUND OF THE INVENTION

The present invention relates generally to a universal accumulator. More particularly, the present invention relates to a universal accumulator for utilization in an automotive air conditioning system, which may be utilized in a variety of automotive applications.

The use of an accumulator in an automotive air conditioning system intermediate to the evaporator and compressor is well known in the art. A typical accumulator comprises an inlet fitting for permitting passage of heavy vapor from the evaporator into a substantially cylindrical canister and an outlet fitting for permitting suction of the refrigerant vapor from the canister to the compressor. A suction tube in fluid communication with the outlet fitting is typically located within the canister. A typical accumulator also comprises one or more service fittings. The purpose of the accumulator is to prohibit liquid refrigerant from returning to the compressor and to provide dehydration via a desiccant located within the accumulator canister.

In the event it becomes necessary to replace an accumulator, the old accumulator must be removed from the automotive air conditioning system and a replacement accumulator installed. The type of replacement accumulator chosen has generally been a function of the relative positions of the line from the evaporator and the line to the compressor. As a result, a variety of designs or styles of accumulators have heretofore been necessary to accommodate the various automotive air conditioning systems One attempt to reduce the necessity for a number of different designs or styles of accumulators has involved the use of an accumulator can having an inlet fitting on the side thereof and an outlet nut in approximately the center of the bottom thereof. The outlet nut is adapted to receive various designs of outlet tubes. The particular outlet tube chosen is determined by the position of the compressor line to which the tube is to be connected. Nevertheless, such apparatus cannot be utilized in automotive applications requiring the accumulator inlet port and outlet port to be in substantially the same horizontal plane.

SUMMARY OF THE INVENTIoN

Accordingly, the present invention provides a universal accumulator which may be utilized as a replacement accumulator and is readily adaptable to a wide variety of automotive air conditioning systems. The present invention further provides a method for replacing an accumulator with the universal accumulator of the present invention, thereby installing the universal accumulator of the present invention in an automotive air conditioning system.

The universal accumulator comprises a housing, an inlet fitting, and an outlet fitting. A pair of service ports are connected to the inlet fitting. The inlet fitting is connected to the top of the housing and provides an inlet port in fluid communication with a cavity within the housing. The outlet fitting may be adjustably connected to approximately the center of the top of the housing by means of an 0-ring fitting connected to the top of the housing. The outlet fitting provides an outlet port which is in fluid communication with the housing cavity when the outlet fitting is connected to the housing. The adjustable connection of the outlet fitting to the housing top permits the variable positioning of the outlet port relative to the inlet port.

The method for replacing a prior accumulator with the universal accumulator of the present invention, thereby installing the accumulator of the present invention in an automotive air conditioning system, comprises the steps of removing the prior accumulator, selectively positioning or adjusting the outlet fitting on the universal accumulator so that the outlet port is at the desired position relative to the inlet port, securing the outlet fitting to the 0-ring fitting connected to the housing, and securing the inlet fitting to the line from the evaporator and the outlet fitting to the line to the compressor. Due to the adjustable connection of the outlet fitting and position of the service ports, the universal accumulator of the present invention may be utilized as a replacement accumulator in a wide variety of automotive applications, including applications which require the inlet port and outlet port to be in substantially the same horizontal plane.

DETAILED DESCRIPTION OF THE PREFERRED EMBODIMENT

Figure 1:
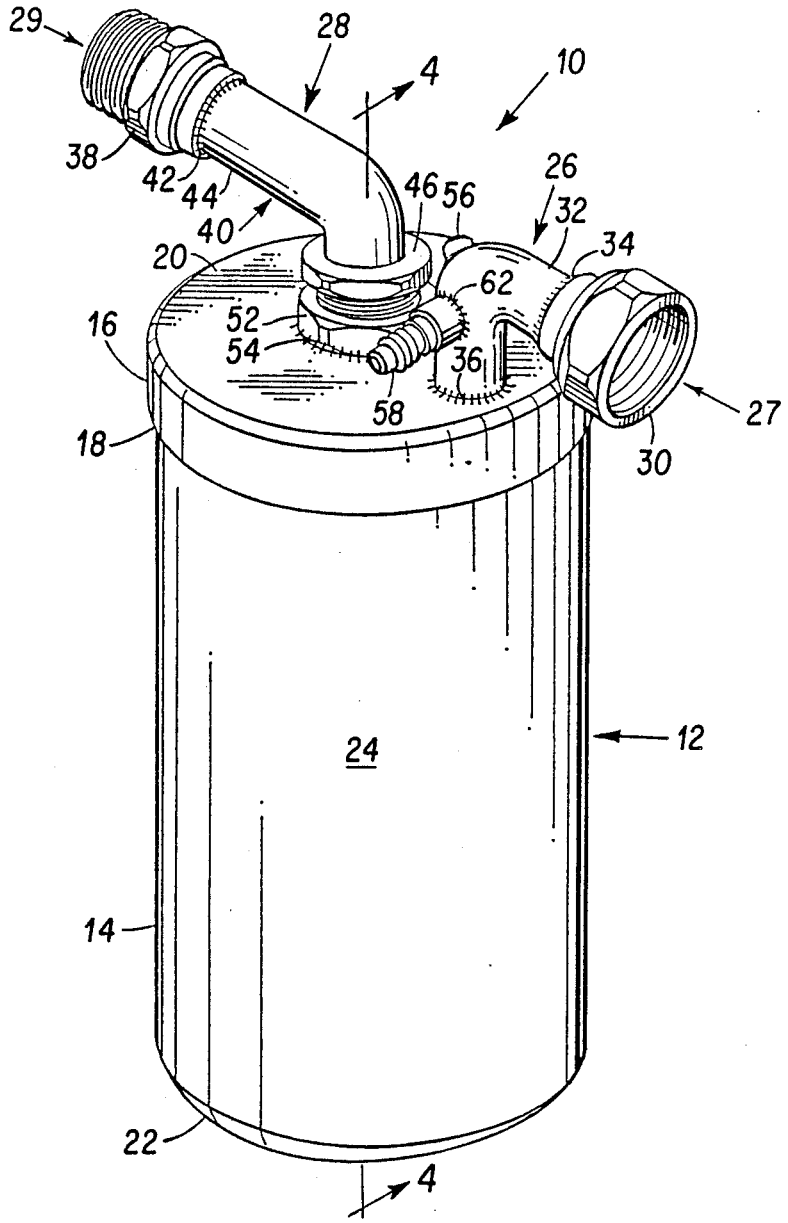
FIG. 1 is a perspective view of the preferred embodiment of the universal accumulator of the present invention.
Figure 2:
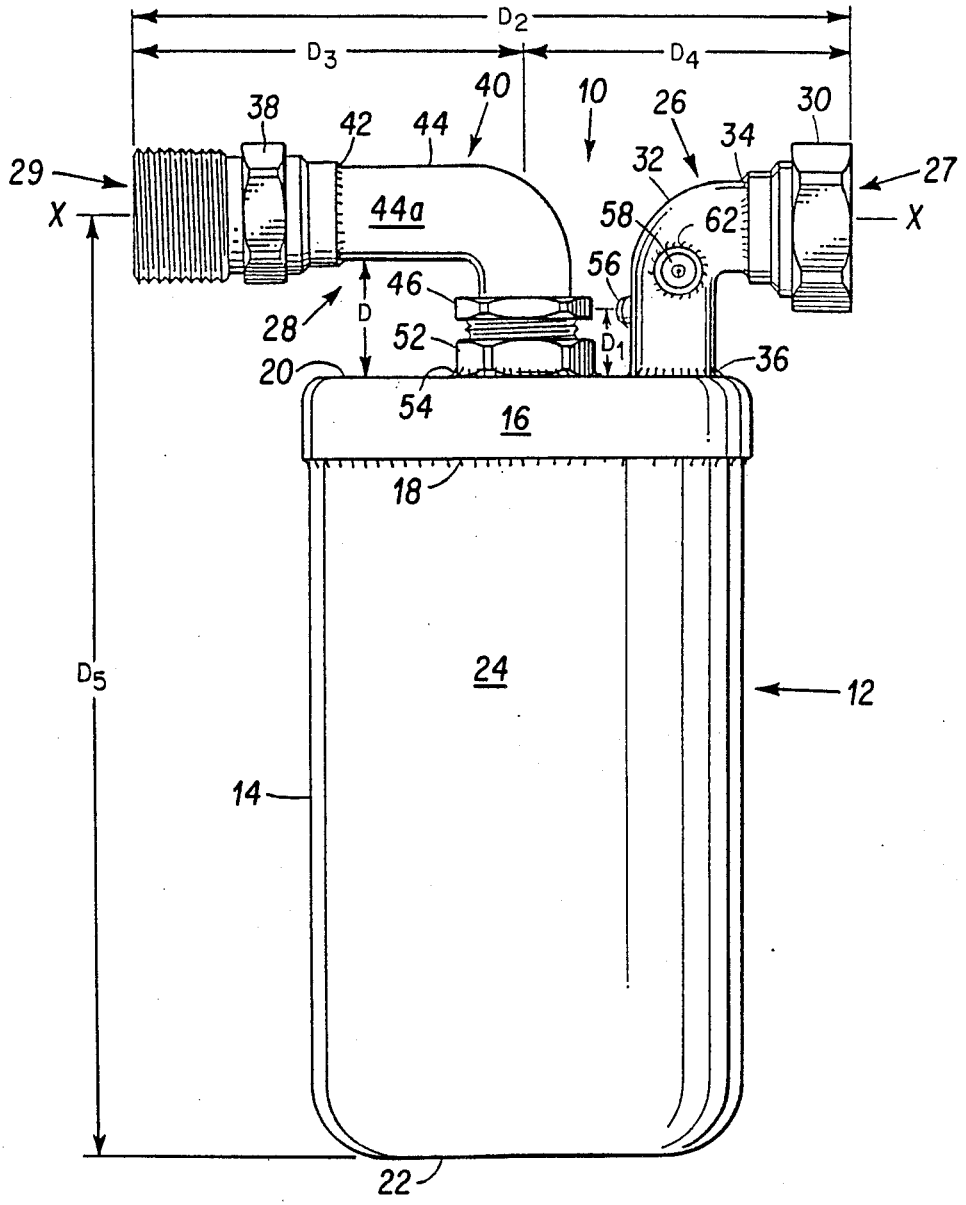
FIG. 2 is a side view of the preferred embodiment of the universal accumulator of the present invention.
Figure 3:
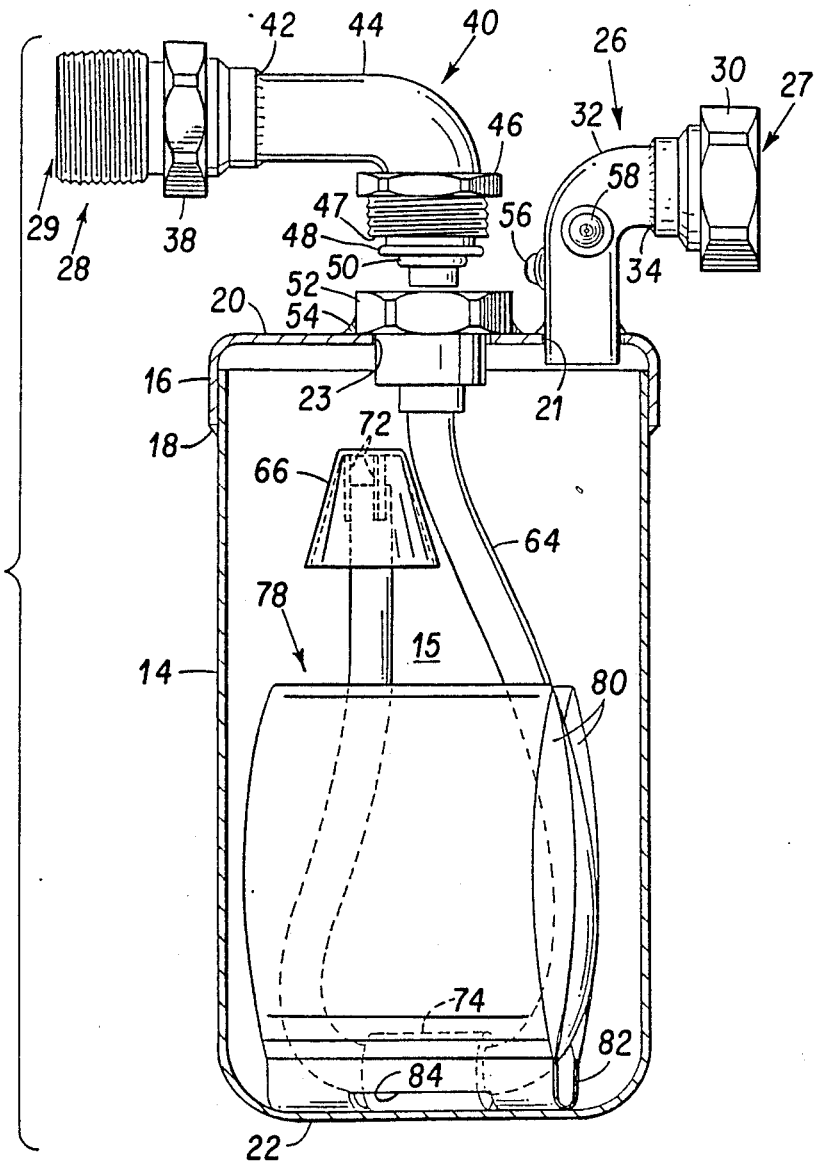
FIG. 3 is a cut-away side view of the preferred embodiment of the universal accumulator of the present invention.

Referring to FIG. 1 and FIG. 2, the preferred embodiment of the universal accumulator of the present invention is identified by the number 10. The accumulator 10 comprises a substantially cylindrical housing or can 12 comprising a base portion 14 and a cap portion 16 connected to base portion 14 by a weld 18. The housing 12 has a top 20, a bottom 22, and a side wall 24 intermediate top 20 and bottom 22. As illustrated in FIG. 3, housing 12 has a cavity 15 therein.

Figure 4:
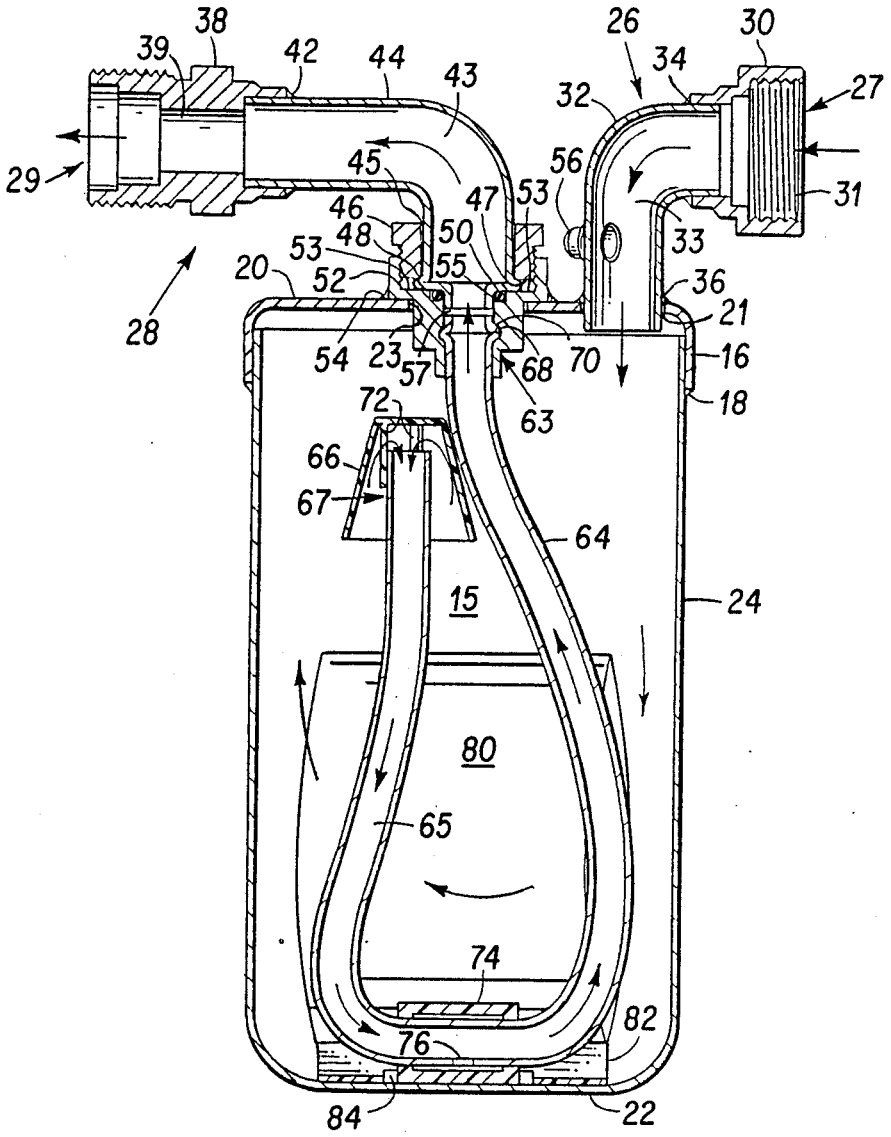
FIG. 4 is a cross-sectional view of the preferred embodiment of the universal accumulator of the present invention taken along section lines 4—4 of FIG. 1.

Referring again to FIG. 1 and FIG. 2, the accumulator 10 further comprises an inlet fitting 26 having an inlet port 27 and an outlet fitting 28 having an outlet port 29. Inlet fitting 26 comprises a female insert 0-ring fitting 30 and a right-angle elbow 32 connected to fitting 30 by a weld 34 As illustrated in FIG. 4, 0-ring fitting 30 has a passage 31 therethrough and elbow 32 has a passage 33 therethrough. Port 27 is in fluid communication with passage 3! and passage 31 is in fluid communication with passage 33. The lower end of elbow 32 extends through a hole 21 in top 20 and elbow 32 is connected to top 20 by a weld 36. Passage 33 is in fluid communication with cavity 15. Fitting 30 is adapted to be connected to a line (not shown) from an automotive air conditioning system evaporator.

Referring again to FIG. 1 and FIG. 2, the outlet fitting 28 comprises a male insert 0-ring fitting 38 and a male 0-ring fitting 40 connected to 0-ring fitting 38 by a weld 42. Fitting 38 is adapted to be connected to a line (not shown) to an automotive air conditioning system compressor. Fitting 40 comprises a right-angle elbow 44 and a nut 46 which is positioned about and slidable along right-angle elbow 44. As illustrated in FIG. 4, nut 46 has a passage 45 therethrough through which elbow 44 extends. As illustrated in FIG. 3 and FIG. 4, nut 46 has external threads and an edge or lip 47. Elbow 44 preferably has a crimp or lip 48 and an 0-ring 50 is preferably positioned about elbow 44 adjacent to lip 48 and intermediate to lip 48 and the lower end of elbow 44 opposite 0-ring fitting 38. As further illustrated in FIG. 4, 0-ring fitting 38 has a passage 39 therethrough and elbow 44 has a passage 43 therethrough. Passage 43 is in fluid communication with passage 39 and passage 39 is in fluid communication with port 29. The inner diameter of elbow 44 between crimp 48 and fitting 38 is preferably substantially the same as the inner diameter of elbow 32. However, the inner diameter of elbow 44 between crimp 48 and the lower end of elbow 44 opposite fitting 38 is preferably less than the inner diameter of elbow 44 between crimp 48 and fitting 38.

Referring to FIG. 3 and FIG. 4, the accumulator 10 further comprises a female insert 0-ring fitting 52 which extends through a hole 23 in approximately the center of top 20 and is connected to top 20 by a weld 54. Fitting 52 has internal threads, an upper shoulder 53, and a lower shoulder 55. 0-ring fitting 52 allows fitting 28 to be removably and adjustably connected to housing 12 in approximately the center of top 20 by the threaded engagement of nut 46 with 0-ring fitting 52. Fitting 28 may be connected to fitting 52 by inserting the lower end of elbow 44 into the passage 57 within fitting 52 until 0-ring 50 rests atop or abuts against shoulder 55 and lip 48 rests atop or abuts against shoulder 53. Nut 46 is thereafter threaded into fitting 52 until lip 47 abuts against lip 48, thereby securing fitting 28 to fitting 52 in a particular position. It is to be understood that elbow 44 and fitting 38 may be rotated or pivoted while elbow 44 is within fitting 52 prior to the securement of fitting 28 to fitting 52 in a particular position by means of the threaded engagement of nut 46 with fitting 52 and the abutment of lip 47 against lip 48. Further, fitting passage 57 is in fluid communication with passage 43 when elbow 44 is received within fitting 52. Finally, fitting 28 may be disconnected from fitting 52 and housing 12 by disengaging nut 46 from fitting 52 and removing elbow 44 from fitting 52.

Figure 5:
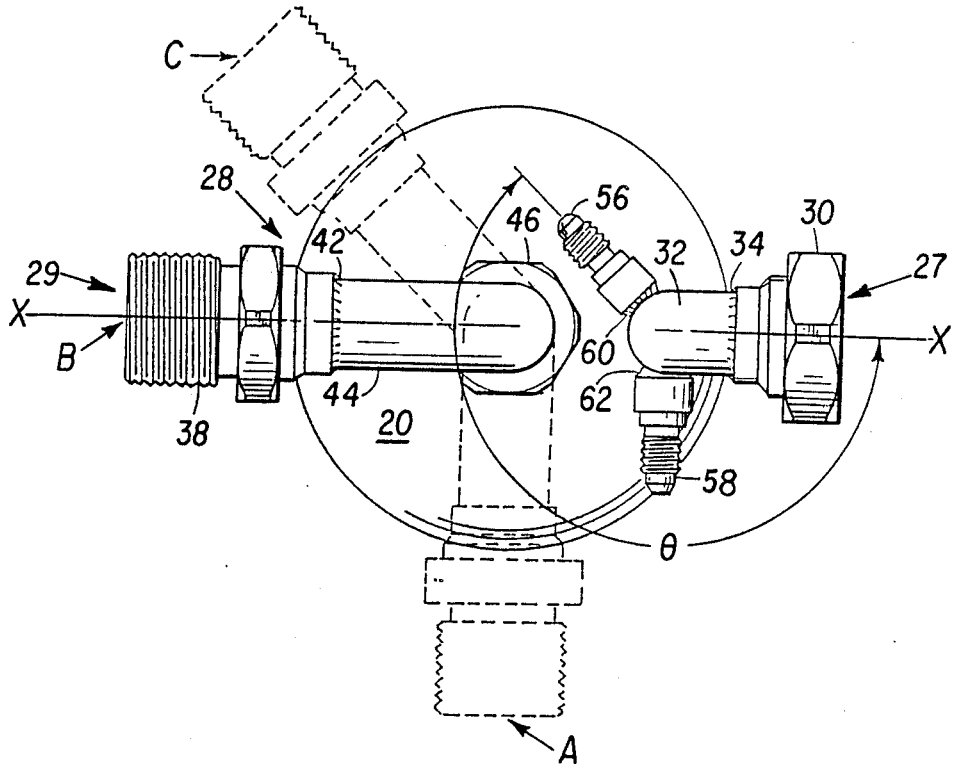
FIG. 5 is a top plan view illustrating the adjustability of the preferred embodiment of the universal accumulator of the present invention.

Referring again to FIG. and FIG. 2, the accumulator 10 further comprises a first service port or fitting 56 and a second service port or fitting 58. As illustrated in FIG. 5, service port 56 is connected to elbow 32 by a weld 60 and service port 58 is connected to elbow 32 by a weld 62. Service fitting 56 and service fitting 58 extend outward from elbow 32 substantially perpendicular to elbow 32. Service fitting 56 is preferably a switch port which may be connected to a pressure cycle switch (not shown) for engaging and disengaging the automotive air conditioning system compressor. Service fitting 58 is preferably an access fitting which may also be connected to an appropriate pressure cycle switch (not shown). Further, service fitting 56 and service fitting 58 each have an access valve core therein. Finally, service fittings 56 and 58 are identical and are adapted to permit fluid communication between passage 33 and a pressure cycle switch.

Referring to FIG. 3 and FIG. 4, the accumulator 10 further comprises a horseshoe style or substantially U-shaped pick-up or suction tube 64 located within cavity 15. The outlet end 63 of tube 64 is connected to 0-ring fitting 52 and the inlet end 67 of tube 64 on the opposite end of tube 64 is connected to a plastic end cap 66. Tube 64 has a passage 65 therethrough in fluid communication with housing cavity 15 and fitting passage 57. Tube 64 preferably has an outside diameter of approximately five-eighths inch (⅝"). The outlet end 63 of tube 64 has a crimp or lip 68 and fitting 52 has a slot or groove 70 therein adapted for mating engagement with crimp 68. Tube 64 is preferably connected to 0-ring fitting 52 by inserting tube end 63 into passage 57 until crimp 68 mates with or is received within groove 70 and tube 64 is thereby locked into fitting 52. End cap 66 is preferably connected to tube 64 by means of a plurality of inner prongs 72 which are integral with cap 66. Prongs 72 fit snugly about the inlet end 67 of tube 64 in a pressure fit and maintain the cap 66 in an appropriate position so as to permit suction of refrigerant vapor into passage 65 through inlet end 67. Cap 66 functions as a baffle to prohibit liquid refrigerant from being suctioned into passage 65.

Referring again to FIG. 3 and FIG. 4, a filter 74 is securely positioned about tube 64 and an oil recovery hole 76 in tube 64. Hole 76 has a diameter of approximately two and onehalf thousandths of an inch (0.0025"). During usage of the accumulator 10, the suction within passage 65 causes refrigeration oil and a minor amount of refrigerant to pass through filter 74 and hole 76 into passage 65 while filter 74 filters out contaminants. As further illustrated in FIG. 3 and FIG. 4, the accumulator 10 further comprises a desiccant bag assembly 78 located within cavity 15. Desiccant bag assembly 78 comprises a pair of desiccant bags 80 which are connected to a plastic strap 82. Strap 82 has a slot or groove 84 therein within which to receive filter 74. Desiccant bag assembly 78 straddles tube 64 so that bags 80 are on opposite sides of tube 64. Desiccant bags 80 function to dehydrate or remove water from the refrigerant within cavity 15.

Referring to FIG. 4, the operation of the accumulator 10 in an automotive air conditioning system will be described in detail. 0-ring fitting 30 is connected to an appropriate line (not shown) so that port 27 is in fluid communication with the automotive air conditioning system evaporator, and 0-ring fitting 38 is connected to an appropriate line (not shown) so that port 29 is in fluid communication with the automotive air conditioning system compressor. When the air conditioning system is active, a suction is created by the compressor, thereby drawing refrigerant vapor (represented by the arrows in FIG. 4) inward through port 27, passage 31 in 0-ring fitting 30, and passage 33 in elbow 32, to be received within housing cavity 15. Refrigerant vapor within housing cavity 15 is drawn through passage 65 in tube 64, passage 57 in fitting 52, passage 43 in elbow 44, passage 39 in 0-ring fitting 38, and outward through port 29. Cavity 15 functions as a temporary reservoir for excess liquid refrigerant.

Referring to FIG. 2 and FIG. 5, the variable positioning of the outlet port 29 relative to inlet port 27 will be described in detail. It is to be understood that, as illustrated in FIG. 2 and FIG. 5, fitting 28 is secured to fitting 52 as described hereinabove and the respective centers of ports 27 and 29 are aligned along substantially horizontal axis X-X approximately one hundred eighty (180) degrees apart. However, the position of outlet port 29 relative to inlet port 27 may be varied by disengaging nut 46 from fitting 52 or loosening nut 46 so that lip 47 does not abut against lip 48, selectively positioning fitting 28 by rotating or pivoting elbow 44 and fitting 38 to the desired position, and securing fitting 28 to fitting 52 in the selected position for fitting 28 by threading nut 46 into fitting 52 until lip 47 abuts against lip 48. For example, when fitting 28 is in position A, as illustrated by the reference lines in FIG. 5, port 29 is at an angle of approximately ninety (90) degrees with respect to port 27. When fitting 28 is in position B, port 29 is at an angle of approximately one hundred eighty (180) degrees with respect to port 27. When fitting 28 is in position C, as illustrated by the reference lines in FIG. 5, port 29 is at an angle of approximately two hundred twenty-five (225) degrees with respect to port 27. Port 29 may be selectively positioned at any angle relative to port 27 within the range of approximately fifteen (15) degrees to three hundred forty-five (345) degrees. Further, the respective centers of inlet port 27 and outlet port 29 will remain in substantially the same horizontal plane regardless of the position of port 29 relative to port 27.

It is to be understood that all of the angles referred to herein are measured clockwise from an imaginary vertical plane which extends through axis X—X. Further, all of the angles referred to herein are measured to the center of the respective port. It is also to be understood that port 56 is preferably at an angle $\theta$ relative to port 27, as illustrated in FIG. 5, and that $\theta$ is preferably approximately two hundred twenty-five (225) degrees. Port 58 is preferably at an angle of approximately ninety (90) degrees relative to port 27.

Referring to FIG. 2, it is to be understood that the vertical distance D between top 20 and the substantially horizontal portion 44*a* of elbow 44 which is substantially parallel to top 20 is approximately one and one-fourth inches (1 ¼″) and the vertical distance $D_1$ between top 20 and the center of port 56 is approximately five-eighths inch (⅝″). It has been determined that the respective dimensions for distance D and distance $D_1$ permit the attachment of an appropriate pressure cycle switch to port 56 regardless of the position of port 29 relative to port 27. That is, distances D and $D_1$ allow sufficient clearance for the fitting 28 to pivot over the pressure cycle switch. It is also to be understood that the horizontal distance $D_2$ between the outer edges of 0-ring fitting 30 and 0-ring fitting 38 is approximately six inches (6″) when the respective centers of ports 27 and 29 are aligned along axis X—X and that the horizontal distance $D_3$ between the outer edge of 0-ring fitting 38 and the center of top 20 is approximately three inches (3″). $D_3$ remains constant regardless of the position of port 29 relative to port 27. The horizontal distance $D_4$ between the outer edge of 0-ring fitting 30 and the center of top 20 is approximately three inches (3″) and also remains constant. The vertical distance $D_5$ between bottom 22 and the respective centers of inlet port 27 and outlet port 29 is approximately eight inches (8″). The vertical distance between top 20 and the center of port 58 is approximately three-fourths inch (¾″). Housing 12 preferably has a length or height of approximately seven inches (7″) and a diameter of approximately three and one-half inches (3-½″).

The method for replacing an accumulator with the accumulator 10 and thereby install the accumulator 10 in an automotive air conditioning system comprises the steps of removing the prior accumulator, loosening nut 46 so that lip 47 does not abut against lip 48 or disengaging nut 46 from fitting 52 (if nut 46 is not already loosened or disengaged from fitting 52), selectively positioning fitting 28 so that port 29 is in the desired position relative to port 27, and securing fitting 28 to fitting 52 in the selected position for fitting 28 by threading nut 46 into fitting 52 until lip 47 abuts against lip 48. 0-ring fitting 30 must thereafter be connected to the line from the evaporator and 0-ring fitting 38 must be connected to the line to the compressor.

It is to be understood that in the event fitting 28 is disconnected from fitting 52, fitting 28 may be selectively positioned by inserting the lower end of elbow 44 into the passage 57 within fitting 52 until 0-ring 50 rests atop or abuts against shoulder 55 and lip 48 rests atop or abuts against shoulder 53. If port 29 is not at the desired position after fitting 28 has been so inserted into fitting 52, elbow 44 and fitting 38 may be rotated or pivoted until port 29 is in the desired position relative to port 27. In the event fitting 28 is already properly received within fitting 52, fitting 28 may be selectively positioned by rotating or pivoting elbow 44 and fitting 38 until port 29 is in the desired position relative to port 27. It is also to be understood that the desired position of port 29 will be dictated by the position of the line to the compresser to which fitting 38 is to be connected.

It is to be understood that housing 12, fittings 26, 28, and 52, and tube 64 are preferably aluminum. Fittings 56 and 58, except for the access valve cores therein, are also preferably aluminum. The filter material within filter 74 is preferably a plastic mesh and 0-ring 50 is preferably rubber. A rubber 0-ring (not shown) may also be provided for the connection of fitting 30 to the line from the evaporator and a rubber 0-ring (not shown) may be provided for the connection of fitting 38 to the line to the compressor. Further, fitting 28 may be appropriately shaped so as to accommodate automotive applications wherein the accumulator outlet port must be in a different horizontal plane than the accumulator inlet port. Finally, it is to be understood that the universal accumulator 10 of the present invention may be utilized in a majority of all automotive applications which require the accumulator inlet port and outlet port to be in substantially the same horizontal plane.

While the universal accumulator has been described in connection with the preferred embodiment, it is not intended to limit the invention to the particular form set forth, but on the contrary, it is intended to cover such alternatives, modifications, and equivalents, as may be included within the spirit and scope of the invention, as defined by the appended claims.

I claim:

1. A method for replacing an automotive air conditioning system accumulator, comprising the steps of:

(a) removing said accumulator from said automotive air conditioning system;

(b) selectively rotating a first fitting of a replacement accumulator relative to a second fitting of said replacement accumulator, said first fitting having a first fitting port and said first fitting being received within a third fitting which is connected to a top of said housing of said replacement accumulator in approximately the center of said housing top, said second fitting having a second fitting port and being connected to said housing top, said first fitting being rotated so that said first fitting port of said replacement accumulator is at an angle relative to said second fitting port within the range of approximately fifteen degrees to three hundred forty five degrees, said replacement accumulator thereby being adapted to accommodate a variety of automotive applications; (c) connecting said replacement accumulator to a first line from an evaporator and a second line to a compressor.

2. A method for replacing an automotive air conditioning system accumulator, as recited in claim 1, further comprising the step of securing said first fitting to said housing top at a desired position wherein said first fitting port is at a desired angle relative to said second fitting port.

3. A method for replacing an automotive air conditioning system accumulator, comprising the steps of:

(a) removing said accumulator from said automotive air conditioning system;

(b) selectively rotating a first fitting of a replacement accumulator relative to a second fitting of said replacement accumulator, said first fitting having a first fitting port and said first fitting being received within a third fitting which is connected to a top of said housing of said replacement accumulator in approximately the center of said housing top, said second fitting having a second fitting port and being connected to said housing top, said first fitting being rotated so that said first fitting port of said replacement accumulator is at an angle relative to said second fitting port within the range of approximately fifteen degrees to three hundred forty five degrees, said first fitting port and said second fitting port being substantially aligned along an axis when said first fitting port is at an angle of approximately one hundred eighty degrees relative to said second fitting port, said replacement accumulator thereby being adapted to accommodated a variety of automotive applications; and (c) connecting said replacement accumulator to a first line from an evaporator and a second line to a compressor.

* * * * *